United States Patent [19]

McNabb

[11] Patent Number: 4,936,468

[45] Date of Patent: Jun. 26, 1990

[54] WALLPAPER DISPLAY AND STORAGE FIXTURE

[76] Inventor: James H. McNabb, 1829 Fair Oaks Pl., Decatur, Ga. 30033

[21] Appl. No.: 398,934

[22] Filed: Aug. 25, 1989

[51] Int. Cl.[5] ..... A47F 7/00

[52] U.S. Cl. ..... 211/59.2; 211/45; 225/38

[58] Field of Search ..... 211/59.2, 16, 45, 128; 225/38, 34

[56] References Cited

U.S. PATENT DOCUMENTS

| | | | |
|---|---|---|---|
| 2,228,775 | 1/1941 | Morgan | 211/128 |
| 2,781,918 | 2/1957 | Palm, Jr. | 211/128 |
| 2,819,851 | 1/1958 | Robertson | 225/38 |
| 3,628,807 | 12/1971 | Fullington | 211/128 X |
| 3,702,672 | 11/1972 | Becht | 225/34 X |
| 3,741,403 | 6/1973 | Fleisher et al. | 225/38 X |
| 4,294,389 | 10/1981 | Falk et al. | 225/34 |

*Primary Examiner*—Blair M. Johnson

*Attorney, Agent, or Firm*—Needle & Rosenberg

[57] ABSTRACT

A fixture for displaying and storing rolls of wallpaper comprising a support having opposed side walls, a back wall and an open front; a plurality of open-topped bins extending between the side walls in an evenly spaced vertical relationship, each of the bins having an unwrapped roll of wallpaper rotably mounted therein with the front edge of the roll displayed over the front wall of the bin; a cutter extending along the top of the front wall of each bin to allow a user to cut off a length of the roll; and a shelf sloping upwardly from the lower rear wall of the bin to the back wall of the support for storing wrapped rolls of wallpaper which are identical to the unwrapped roll in the associated bin.

2 Claims, 1 Drawing Sheet

WALLPAPER DISPLAY AND STORAGE FIXTURE

BACKGROUND OF THE INVENTION

This invention relates to the display and storage of rolls of wallpaper in a showroom environment. The term "wallpaper" is used herein to encompass any wallpaper, wallcovering borders or wrapping paper or combinations of the same.

It is common for a customer in shopping for wallpaper and the like to make a decision based only upon reviewing various examples of wallpaper in sample books and then buying one or more of the wrapped rolls of the desired design or color. Normally, if the purchaser desires to take home a sample or samples of wallpaper, an employee of the store must first be found and then requested to cut such sample or samples from an unwrapped wallpaper roll or rolls, if such roll or rolls are available. It is not uncommon for such sample(s) to be cut off of the piece of wallpaper in the sample book(s). There is, at present, no known means available in one compact structure for displaying a portion of a roll of wallpaper and allowing the consumer or the store employee to easily remove such portion while allowing, at a subsequent time, another sample of that same wallpaper pattern to be easily cut from the roll, while also providing a readily accessible storage area adjacent the open roll for unwrapped rolls of the same wallpaper which the consumer can purchase.

SUMMARY OF THE INVENTION

The above disadvantages are overcome by the present invention which provides for a structure which, in its front portion, presents in separate bins a variety of rolls of different wallpaper patterns from which a consumer can easily view the different wallpaper patterns available and remove by himself or herself also a portion from one or more of the rolls. A storage area is provided in the rear of each of the bins for wrapped rolls bearing the same patterns as those displayed in the associated bin, the storage area being readily accessible to the consumer.

Specifically, the structure comprises a frame or support which has opposed sides, a back and an open front. Laterally extending between the sides in a spaced, vertically stepped relationship are a plurality of open-topped bins which contain a roll of unwrapped wallpaper, each bin to receive a roll bearing a different pattern or color. The top of the front wall of each bin has a cutting edge so that the user can cut off from the free end of the roll in that bin a pre-selected length of the wallpaper for sample purposes.

A shelf slants upwardly from the rear of each bin towards the back wall of the frame in order to store wrapped rolls bearing the same pattern or color as the roll in the associated bin. Enough space is provided between the bins so that a prospective purchaser can reach over and behind a bin and select one or more of the desired rolls for purchase.

The fixture, therefore, provides a practical and attractive means for displaying the different patterns available in a wallpaper establishment, allowing a purchaser to remove easily a sample of a selected roll of wallpaper and storing adjacent the respective displayed roll, rolls of that same wallpaper that can be purchased.

DETAILED DESCRIPTION OF THE ILLUSTRATIVE EMBODIMENT

Figure 1:
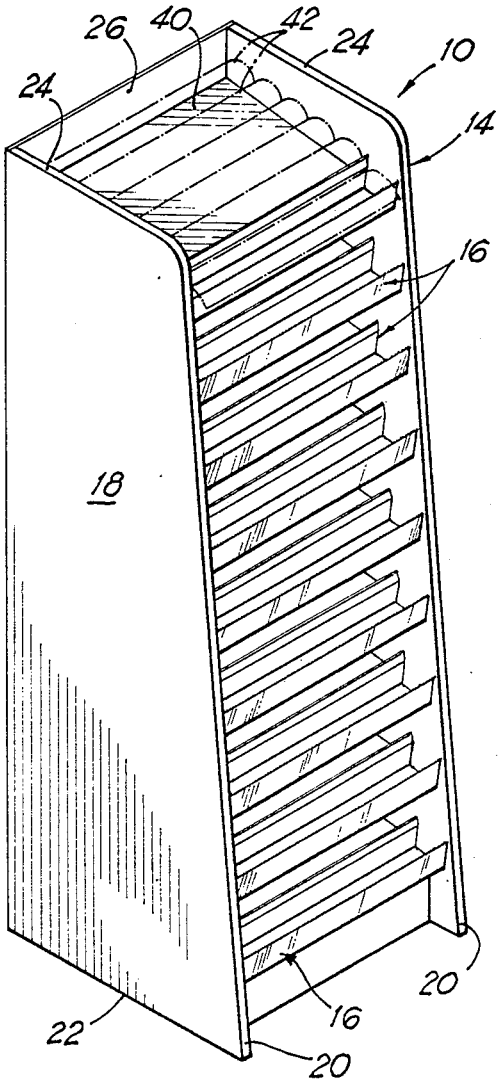
FIG. 1 is a perspective view of the display and storage fixture of the present invention.

Referring to the figures of the drawing, the numeral 10 denotes generally the present invention, which comprises a frame 14 and wallpaper bins 16. The frame includes a pair of opposed sides 18 with front edges 20 which taper inwardly from bottoms 22 to the respective top edges 24 of the sides 18. A back wall 26 interconnects, and is the same height as, the sides 18. The frame 14 has an open front and top.

A plurality of bins 16 laterally extend between the inner surfaces of the sides 18 adjacent the front edges 20. Each bin 16 comprises a flat bottom 28, a front wall 30, an opposed, parallel rear wall 32 and an open top and is of a size to receive therein a roll of wallpaper 34. Means is provided on each of the bins 16 for cutting a pre-selected length of wallpaper from the roll 34 and, preferably, takes the form of either having a cutting blade disposed along the top of the front wall 30 or having the top of the front wall 30 in the form of a cutting surface 36. The latter can occur when the bins 16 are constructed of plastic so that the cutting surface 36 has one edge slanted downwardly away from the top. In this manner, a customer can remove the portion of the roll 34 that extends over the cutting surface 36

Each of the rolls 34 is releasably and rotably maintained within each bin 16. That may be accomplished, as shown, by having each roll 34 mounted on a shaft or dowel 38 that has each of its ends secured into routed holes 39 in opposite sides of the inner surface of sides 18. The shaft 38 may be spring loaded.

Figure 2:
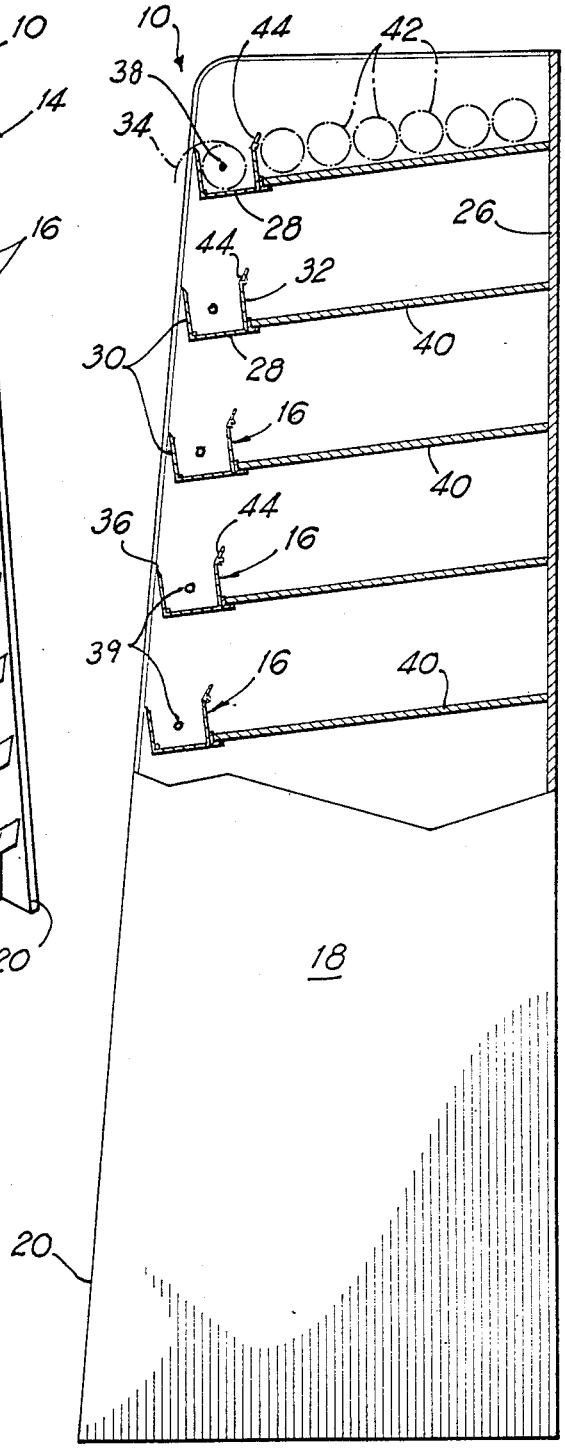
FIG. 2 is a side elevational view of the fixture with a portion of the right-hand side wall broken away for clarity.

As seen in FIG. 2, each of the bins 16 is tilted forward within the frame 14. Extending to the back wall 26 from a lip on the bottom of the rear wall 32 and in the same plane as bottom 28 is a shelf 40 on which are stacked wrapped rolls of wallpaper 42 which are of the same pattern or color as the wallpaper roll 34 that is within an associated bin. The rear wall 32 of each bin terminates in an upper portion 44 which slopes upwardly toward the back wall 26 to retain the rolls 42 within the storage space formed by the shelf 40. The tilting of the bins 16 within the frame 14 allows for the cutting surface 36 to be positioned below the upper portion 44 and minimizes the chance of a consumer coming into contact with the cutting surface 36 when he or she reaches over a bin 16 into the respective storage space.

Also as seen in FIG. 2, the bins 16 and associated shelves 40 are vertically arranged in a spaced, stepped configuration with the smallest shelf 40 being at the top of the frame 14. Sufficient space is provided between each bin 16 and shelf 40 to allow the purchaser to have easy access to the roll 34 in each bin 16 as well as to allow that person to reach behind the bin 16 to obtain the desired number of wrapped rolls 42.

The fixture 10 can be constructed of any suitable material, such as hard, clear plastic.

What I claim is:

1. A display and storage fixture for rolls of wallpaper, comprising:

(a) a frame having opposed sides with front edges, a back wall interconnecting said sides and an open front;

(b) a bin extending between said sides and across said open front adjacent said front edges and having a bottom, a front wall, an opposed rear wall and an open top, a roll of wallpaper being rotably disposed within said bin about the longitudinal axis of said roll;

(c) means for releasably and rotably maintaining said roll within said bin;

(d) means on said bin for cutting a pre-selected length of wallpaper from said roll after said length has been unwound from said roll; and (e) a shelf within said support extending from said rear wall of said bin to said back wall of said frame so as to define a space within said frame for receiving therein said rolls of wallpapers, wherein said rear wall of said bin includes an upwardly extending lower portion which is substantially parallel to said front wall and which terminates in an upper portion which slopes upwardly toward said back wall of said frame so as to retain said rolls of wallpaper within said space, wherein said cutting means is disposed along the top of said front wall, and wherein said cutting means is disposed at a lower height than said upper portion of said rear wall of said bin.

2. A display and storage fixture as claimed in claim 1 wherein said bottom of said bin is in a co-planar relationship with said shelf.

* * * * *